US007736133B2

(12) United States Patent
Martinez

(10) Patent No.: US 7,736,133 B2
(45) Date of Patent: Jun. 15, 2010

(54) CAPSULE FOR TWO DOWNHOLE PUMP MODULES

(75) Inventor: Ignacio Martinez, Rio de Janeiro (BR)

(73) Assignee: Baker Hughes Incorporated, Houston, TX (US)

( * ) Notice: Subject to any disclaimer, the term of this patent is extended or adjusted under 35 U.S.C. 154(b) by 335 days.

(21) Appl. No.: 11/750,014

(22) Filed: May 17, 2007

(65) Prior Publication Data

US 2007/0274849 A1 Nov. 29, 2007

Related U.S. Application Data

(60) Provisional application No. 60/802,626, filed on May 23, 2006.

(51) Int. Cl.
*F04B 35/00* (2006.01)
*E21B 43/00* (2006.01)

(52) U.S. Cl. ..... 417/423.3; 417/423.2; 417/423.5; 166/105; 166/105.5; 166/369

(58) Field of Classification Search ..... 166/105, 166/105.5, 369, 370, 372, 380; 417/42.3, 417/244, 423.3, 423.5, 424.1, 426
See application file for complete search history.

(56) References Cited

U.S. PATENT DOCUMENTS 5,099,920 A * 3/1992 Warburton et al. ..... 166/250.03
6,082,452 A 7/2000 Shaw et al.
6,138,758 A 10/2000 Shaw et al.
6,325,143 B1 * 12/2001 Scarsdale ..... 166/54.1
6,412,563 B1 7/2002 St. Clair et al.
6,595,295 B1 7/2003 Berry et al.
6,691,782 B2 2/2004 Vandevier
6,964,299 B2 * 11/2005 Scarsdale ..... 166/105
2004/0060707 A1 4/2004 Bearden et al.

FOREIGN PATENT DOCUMENTS

GB 2071766 A 9/1981
GB 2345307 A 7/2000

* cited by examiner

*Primary Examiner*—David J Bagnell
*Assistant Examiner*—Michael Wills, III
(74) *Attorney, Agent, or Firm*—Bracewell & Giuliani LLP

(57) ABSTRACT

Upstream and downstream pump assemblies are mounted in a capsule having a bulkhead between the upstream and downstream pump assemblies, dividing the capsule into upstream and downstream chambers sealed from each other. In a dual operation mode, well fluid flows through the inlet of the capsule into the upstream chamber, where it is pumped to a first pressure level by the upstream pump assembly and discharged into the downstream chamber. The downstream pump assembly then pumps the well fluid to a second pressure level and discharges the well fluid out the outlet of the capsule. The assembly has also an upstream pump assembly only operational mode and a downstream pump assembly only operational mode.

19 Claims, 4 Drawing Sheets

CAPSULE FOR TWO DOWNHOLE PUMP MODULES

CROSS REFERENCE TO RELATED APPLICATION

This application claims priority to provisional application 60/802,626, filed May 23, 2006.

FIELD OF THE INVENTION

This invention relates in general to an electrical submersible pump (ESP) and in particular to a downhole capsule containing two ESP modules.

BACKGROUND OF THE INVENTION

An electrical submersible pump ("ESP") assembly for wells typically comprises a submersible motor that drives a pump, typically a centrifugal pump. The pump assembly is usually suspended on a string of tubing within the well. The power cable to the motor is strapped alongside the tubing. Periodically, the pump assembly has to be retrieved for maintenance or repair, and this step requires pulling the tubing. Pulling the tubing requires a workover rig and is time consuming, particularly for offshore installations.

In some cases a dual tandem pump assembly is used to provide more lift. Normally two pumps are connected together and driven by a single motor. The pumps thus operate in unison with each other. Repair or replacement of either pump requires pulling the tubing and the entire assembly.

Often a pressure and temperature sensor will be mounted to the base of the motor for sensing the pressure and temperature of the dielectric liquid within the motor. The power to the motor fluid sensor and the signals are superimposed on the ESP power cable. Another measuring tool comprises a reservoir sensor, which is an electrical device that senses various characteristics of the producing reservoir of the well on the exterior of the motor. These tools typically send signals up a dedicated communication line extending to the surface.

SUMMARY

In this invention a capsule having an upper end for connection to a string of production tubing is lowered within casing of a well. An electrical submersible pump assembly is located within and suspended by the upper end of the capsule. A bulkhead is located within the capsule below the pump assembly. An electrically powered device is suspended by and below the bulkhead. A power lead extends from the electrically powered device through the bulkhead, alongside the pump assembly within the capsule and sealingly through the upper end of the capsule. The electrically powered device may be suspended below the capsule or contained within the capsule.

The electrically powered device may be a sensor for sensing reservoir characteristics or it may be a second submersible pump assembly. In one embodiment having two ESP's, the bulkhead divides the capsule into upstream and downstream chambers, each chamber containing one of the pump assemblies. The power cables for each motor pass through the capsule alongside the outlet. The two submersible pump assemblies may operate simultaneously or one may operate while the other is shut down.

The reservoir sensor unit may be suspended below the hanger or bulkhead. The power and signals for the reservoir sensor unit may be supplied via a dedicated sensor line to the surface, or the sensor line may only extend to the motor sensor. In the latter case, the reservoir sensor and the motor sensor may be superimposed on the ESP power cable.

DETAILED DESCRIPTION OF THE INVENTION

Figure 1A:
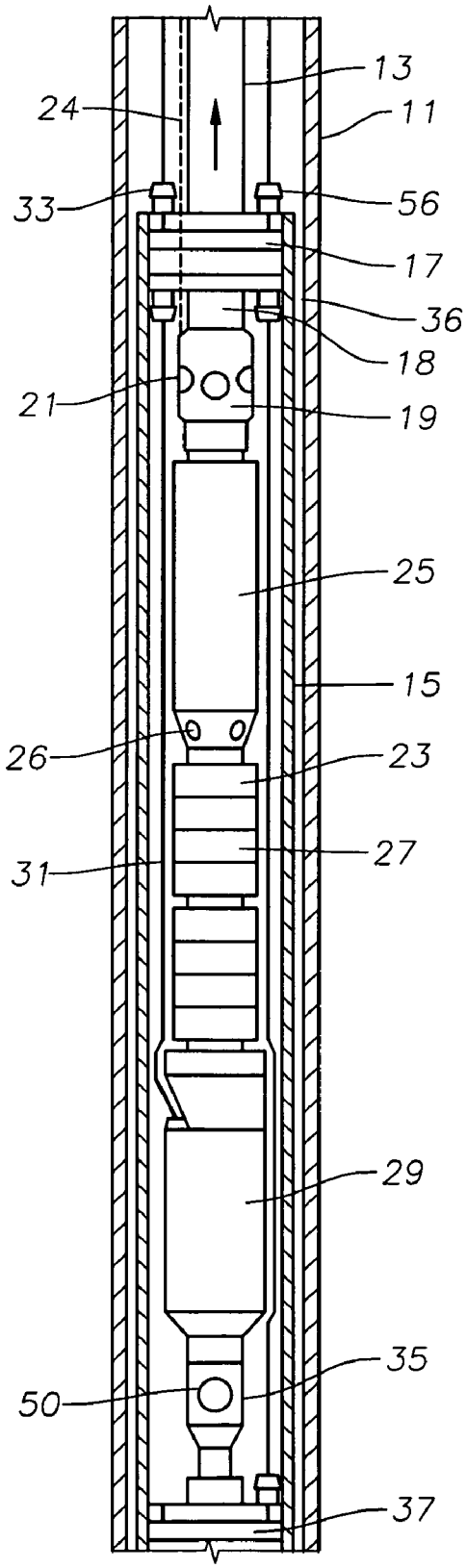
FIGS. 1A and 1B comprise a vertical sectional view of a capsule containing two ESP modules in accordance with this invention.

Referring to FIG. 1, a well having a casing 11 is illustrated. Casing 11 is perforated at its lower end for allowing well fluid to enter. A string of production tubing 13 is suspended within casing 11. A capsule 15 is secured to a lower end of tubing 13.

Capsule 15 is a cylindrical member of slightly smaller outer diameter than the inner diameter of casing 11 so that it can be lowered into casing 11 on tubing 13. Capsule 15 has an upper or downstream end with a hanger 17 that is rigidly secured to the lower end of tubing 13.

An optional upper or downstream sleeve valve 19 is secured into a downstream conduit 18 below upper hanger 17. Upper sleeve valve 19 has an interior that is communication with the interior of tubing 13 for discharging well fluid upward. Upper sleeve valve 19 has an open position in which ports 21 on its sidewall are exposed to the interior of capsule 15. Upper sleeve valve 19 has a closed position in which ports 21 are closed to the interior of capsule 15.

An upper or downstream ESP 23 is suspended on upper sleeve valve 19. Upper sleeve valve 19 may be a commercially available type that closes its ports 21 to the interior of capsule 15 when downstream ESP 23 is operating. When ESP 23 is not operating, upper sleeve valve 19 automatically opens its ports 21 to the interior of capsule 15. This type of valve, known as an annulus diverter valve, is used normally in tubing above submersible pumps in applications that are prone to significant sand production. Alternately, upper sleeve valve 19 could be hydraulically actuated or stroked between the open and closed positions by pressure supplied from the surface via a hydraulic line 24 that extends alongside tubing 13 and sealingly through upper hanger 17.

If upper sleeve valve 19 is not utilized, upper ESP 23 would connect directly to upper hanger 17. Upper ESP 23 is a conventional electrical submersible pump assembly, including a centrifugal pump 25, which is shown at the upper end of the assembly. Pump 25 has an intake 26 on its lower end and is made up of a large number of stages or impellers and diffusers. One or more seal sections 27 are connected to the lower end of pump 25. An electrical motor 29 is connected to the lower end of the seal section or sections 27. Motor 29 is preferably a three-phase alternating current motor. Motor 29 is filled with lubricant, and seal sections 27 equalize the interior pressure of the lubricant in motor 29 with the pressure in capsule 15.

Motor 29 has an electrical power lead 31 that extends upward alongside seal section 27 and pump 25 within capsule 15. Motor lead 31 extends through an upper penetrator or guide 33 in upper hanger 17. Upper penetrator 33 seals motor lead 31 in upper hanger 17. Above capsule 15, motor lead 31 joins a power cable (not shown) that is strapped alongside tubing 13 and extends to the surface.

A lower extension pipe 35 extends from the lower end of motor 29 to a lower hanger or bulkhead 37 located within capsule 15. Lower hanger 37 is sealed to the sidewall of capsule 15, defining an upper or downstream chamber 36 above lower hanger 37 and a lower or upstream chamber 38 below lower hanger 37. A downstream conduit or support tube 39 secured to the lower side of lower hanger 37 is illustrated in FIG. 1B. An optional sliding sleeve valve 41 is connected to the lower end of support tube 39. Sliding sleeve valve 41 has ports 43 that lead to the interior of capsule 15 and may be of the same type of valve as upper sliding sleeve valve 19.

Figure 6:
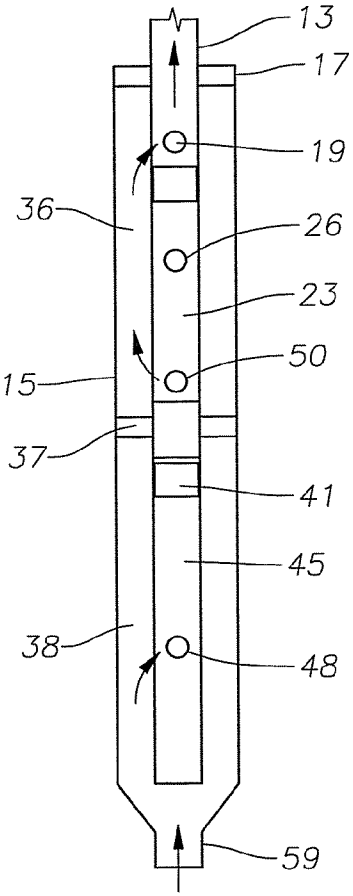
FIG. 6 is a schematic view illustrating the lower ESP of the capsule of FIG. 1 operating and the upper ESP not operating.
Figure 5:
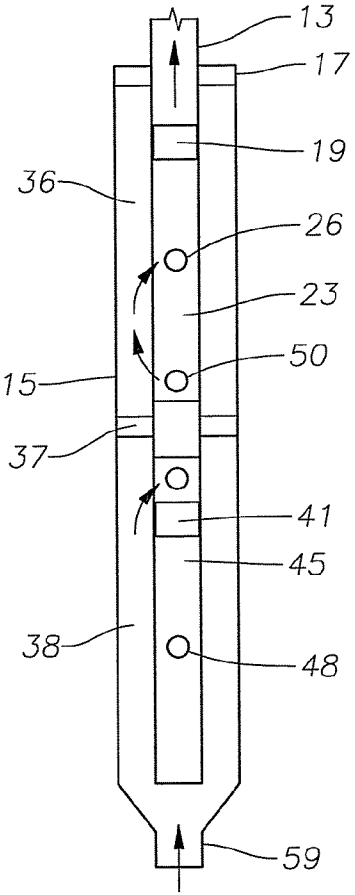
FIG. 5 is a schematic view illustrating the upper ESP of the capsule of FIG. 1 operating and the lower ESP not operating.

A lower or upstream ESP 45 is secured to the lower end of lower sliding sleeve valve 41, and its weight is supported by upper hanger 17 through upper ESP 23 in this embodiment. Sleeve valve 41 also may be an annulus diverter type that automatically closes ports 43 when lower ESP 45 is operating and opens ports 43 when ESP 45 is not operating. Alternately, sleeve valve 41 could open and close ports 43 in response to hydraulic fluid pressure supplied from a line 44 extending to the surface. If desired, lower sliding sleeve valve 41 may be operated independently of upper sleeve valve 19 by a separate hydraulic line from the hydraulic line leading to upper sleeve valve 19. Alternatively, a single hydraulic line could control both sleeve valves 19, 41. For example, if lower ESP 45 is a back up to be operated only after upper ESP 23 fails, sleeve valve 41 could be connected to the same hydraulic line as upper sleeve valve 19 and operated in reverse to upper sleeve valve 19. That is, while only upper ESP 23 is operating, as illustrated in FIG. 5, the hydraulic pressure in the hydraulic line to sleeve valves 19, 41 keeps sleeve valve 19 closed and sleeve valve 41 open. When upper ESP 23 is shut down and lower ESP 45 started, the hydraulic pressure in the line to valves 19, 41 would be reversed by an operator at the surface to open upper sleeve valve 19 and close lower sleeve valve 41, as shown in FIG. 6.

If a lower sleeve valve 41 is not utilized, lower ESP 45 will be secured directly to support tube 39. Lower ESP 45 may be the same type as upper ESP 23, although it may be of a different length, if desired. Lower ESP 45 includes a centrifugal pump 47 with an intake 48. Discharge port 50 of lower ESP 45 is in extension pipe 35 in upper chamber 36. One or more seal sections 49 connect pump 47 to electrical motor 51. A motor lead 53 extends from the upper end of motor 51 through a lower hanger penetrator 55 in lower hanger 37. Penetrator 55 seals motor lead 53 within lower hanger 37. Lower ESP motor lead 53 extends alongside upper ESP 23 and through an upper penetrator 56 located within upper hanger 17 to a power cable (not shown) extending to the surface. Capsule 15 has an inlet 59 located below the lower end of lower ESP 45. Inlet 59 communicates well fluid in casing 11 to lower chamber 38 surrounding lower ESP 45. Optionally inlet 59 comprises a stinger that stabs into a packer (not shown). The packer isolates the well fluid below it from the fluid within casing 11 surrounding capsule 15 and production tubing 13.

Figure 2:
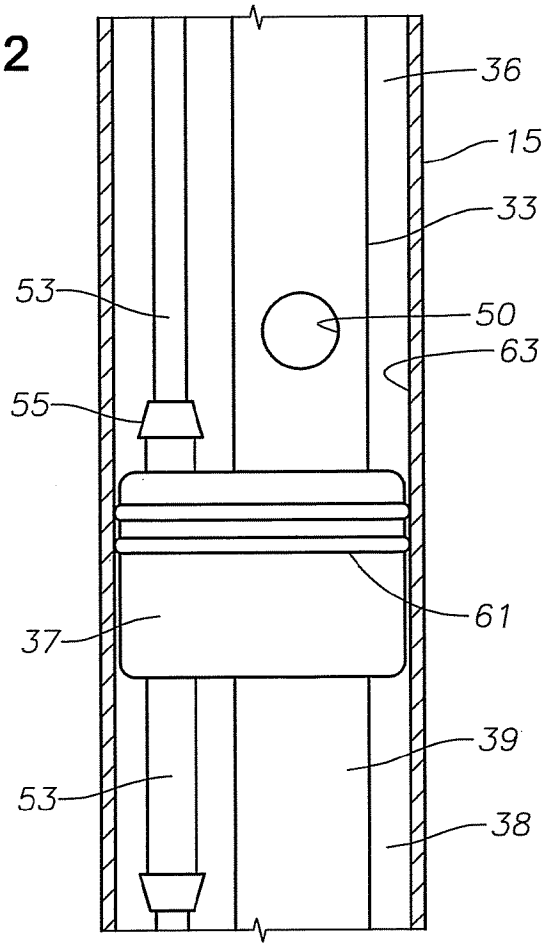
FIG. 2 is an enlarged sectional view of the lower hanger contained within the capsule of FIG. 1.

FIG. 2 illustrates a first embodiment of bulkhead or lower hanger 37. In this embodiment, lower hanger 37 has seals 61 that seal against a polished bore 63 on the inner diameter of capsule 15. Hanger 37, along with seals 61, is able to slide axially along polished bore 63 as indicated by the arrows. This axial movement of lower hanger 37 accommodates thermal growth of upper ESP 23 (FIG. 1A) during operation. Lower ESP 45 is able to grow thermally because its lower end is spaced above capsule inlet 59 and is free to move. The entire weight of both upper and lower ESP's 23, 45 is supported by upper hanger 17 in the embodiment of FIG. 2.

Figure 3:
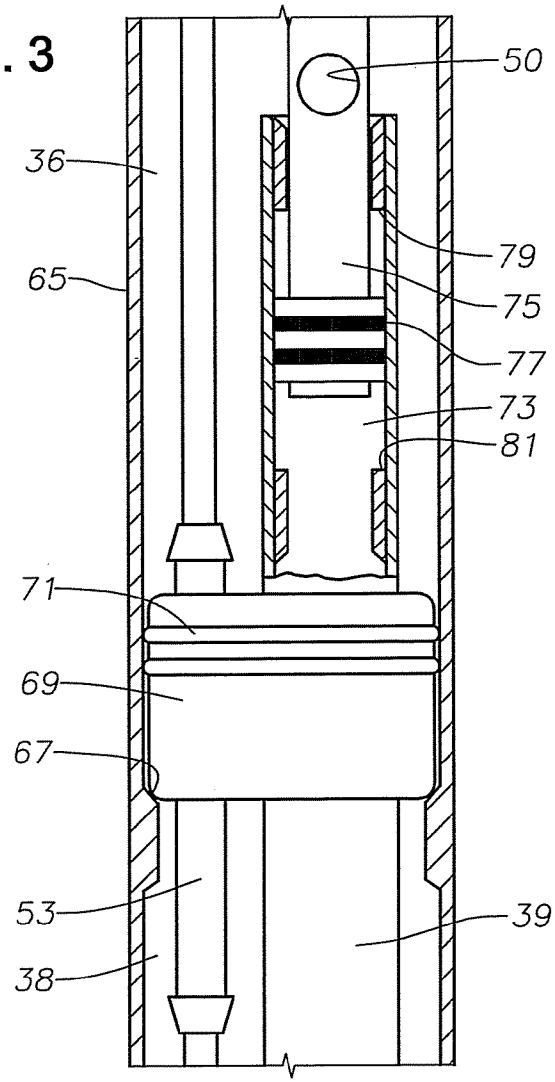
FIG. 3 is an alternate embodiment of the lower hanger contained in the capsule of FIG. 1.

In the embodiment of FIG. 3, capsule 65 differs from capsule 15 of the first embodiment in that it has a load shoulder 67 located on the inner diameter. Lower hanger 69 lands on load shoulder 67 so as to support the weight of lower ESP 45 (FIG. 1B). Lower hanger 69 has seals 71 that statically engage a seal surface on the inner diameter of capsule 65 above load shoulder 67.

Figure 1B:
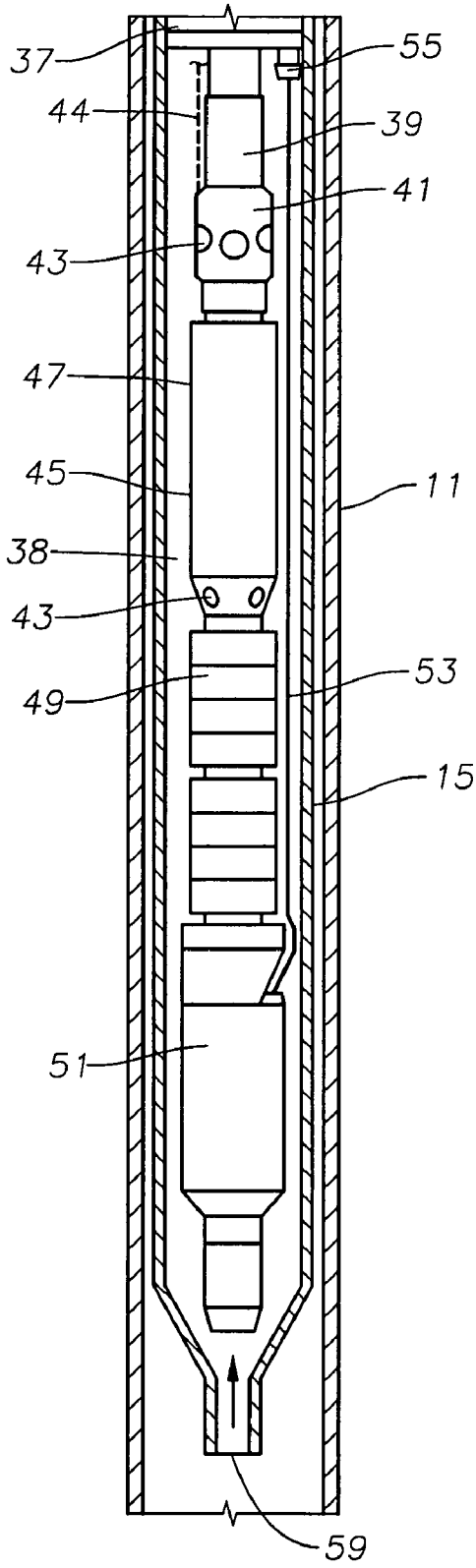

To accommodate thermal growth of upper ESP 23 (FIG. 1A) in the embodiment of FIG. 3, a telescoping joint is utilized for connecting between lower hanger 69 and the assembly of ESP 23 (FIG. 1A). This telescoping joint includes an upward facing receptacle 73 in this example. Receptacle 73 is open at its upper end and slidingly receives a tubular mandrel 75 that is rigidly secured to the lower end of upper ESP 23 (FIG. 1A). Mandrel 75 has seals 77 that will slidingly engage a seal surface within receptacle 73. Upper and lower stops 79, 81 limit the travel of mandrel 75 relative to receptacle 73 during installation of ESP 23 in capsule 65. Receptacle 73 and mandrel 75 could alternately be reversed with mandrel 75 mounted to hanger 69 and receptacle 73 mounted to the lower end of upper ESP 23. Discharge port 82 from lower ESP 45 (FIG. 1B) is located in mandrel 75.

In a third embodiment (not shown), instead of lower hanger 37 (FIG. 2) or 69 (FIG. 3), the bulkhead would be a packer that is conventionally actuated to expand, grip and seal to the inner surface of capsule 15. In that embodiment, the packer would support the weight of lower ESP 45 and would not be movable either upward or downward in capsule 15.

In operation, upper and lower ESP'S 23, 45 are installed within capsule 15 while at the surface. The entire assembly then is lowered into the well on tubing 13. The upper ends of motor leads 31, 53 are connected to power cables (not shown), which are strapped alongside tubing 13. While being lowered, capsule 15 protects motor leads 31 and 53 against damage in the areas where they pass alongside upper seal section 27 and upper pump 25. Because both motor leads 31 and 53 pass alongside these components, the clearance within casing 11 can be quite small.

Figure 4:
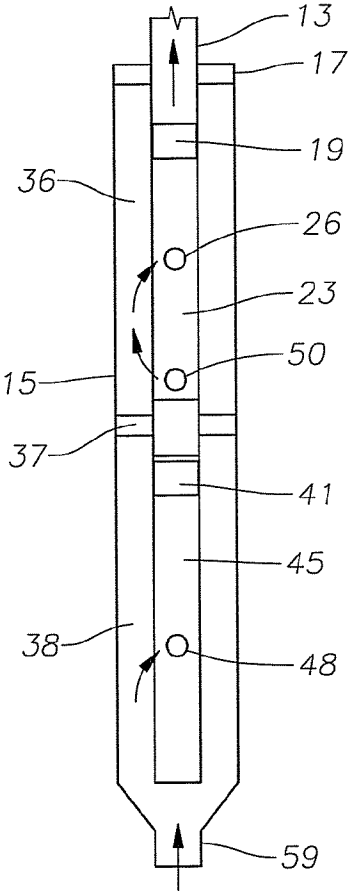
FIG. 4 is a schematic view illustrating both ESP's of the capsule of FIG. 1 operating.

Once capsule 15 is at the desired depth, the operator has a choice of simultaneously operating both upper and lower ESP's 23, 45 as shown in FIG. 4, operating only the upper ESP 23 as shown in FIG. 5, or operating only the lower ESP 45 as shown in FIG. 6. To operate both ESP's 23, 45 simultaneously, the operator supplies power to both motors 29, 51 (FIG. 1) and both upper and lower sleeve valves 19, 41 are closed, either automatically or by hydraulic pressure supplied from the surface. In fact, if the operator intends to always operate both ESP's 23, 45 simultaneously, sleeve valves 19, 41 are not required.

In the booster mode of FIG. 4, well fluid flows through capsule inlet 59 into lower chamber 38 and lower pump intake 48. Lower ESP 45 increases the pressure of the well fluid and discharges it from lower pump discharge port 50 into upper chamber 36 of capsule 15. The higher pressure in upper chamber 36 is isolated by lower hanger 37 from the intake pressure in lower chamber 38. The higher pressure fluid enters upper pump intake 26, which boosts the pressure and discharges the well fluid into production tubing 13. In this mode, ESP's 23, 45 operate in series.

As illustrated in FIG. 5, in this mode, only upper ESP 23 operates. To avoid flowing well fluid through the stages of the non operating pump of lower ESP 45, lower sleeve valve 41 is opened. Opening lower sleeve valve 41 could be done by hydraulic fluid pressure. Alternately, if automatic sleeve valves 19, 41 are used, merely supplying power to upper ESP 23 while not supplying power to lower ESP 45 will cause lower sleeve valve 41 to open while upper sleeve valve 19 remains closed. In this mode, the well fluid bypasses the pump of lower ESP 45, flows from lower chamber 38 into the ports of lower sleeve valve 41 and discharges out lower pump discharge port 50 into upper chamber 36 of capsule 15. The pressure in upper chamber 36 is substantially the same as at capsule inlet 59. The well fluid flows into upper pump intake 26, which discharges it at a higher pressure into tubing 13.

Referring to FIG. 6, in this mode, upper ESP 23 is not operating, rather only lower ESP 45. This mode might occur after upper ESP 23 failed, in which case lower ESP 45 is energized as a back up. Upper sliding valve 19 is opened, and lower sliding valve 41 is closed, either by hydraulic fluid pressure or by automatic valves, as discussed. The well fluid flows from lower chamber 38 into lower pump intake 48 and is discharged out lower pump discharge 50 in upper chamber 36 at a higher pressure. The well fluid flows into the open ports of upper sleeve valve 19 rather than flowing through the stages of the pump of upper ESP 23. The well fluid is discharged into tubing 13 at substantially the same pressure that it was discharged from lower ESP discharge 50.

In another embodiment, which isn't shown, the lower end of capsule 15 terminates at lower hanger 37. Lower ESP 45 is not located within capsule 15, but is suspended by lower hanger 37. Lower ESP 45 may have a tail pipe or stinger in that instance that would sting into a packer (not shown).

Figure 7:
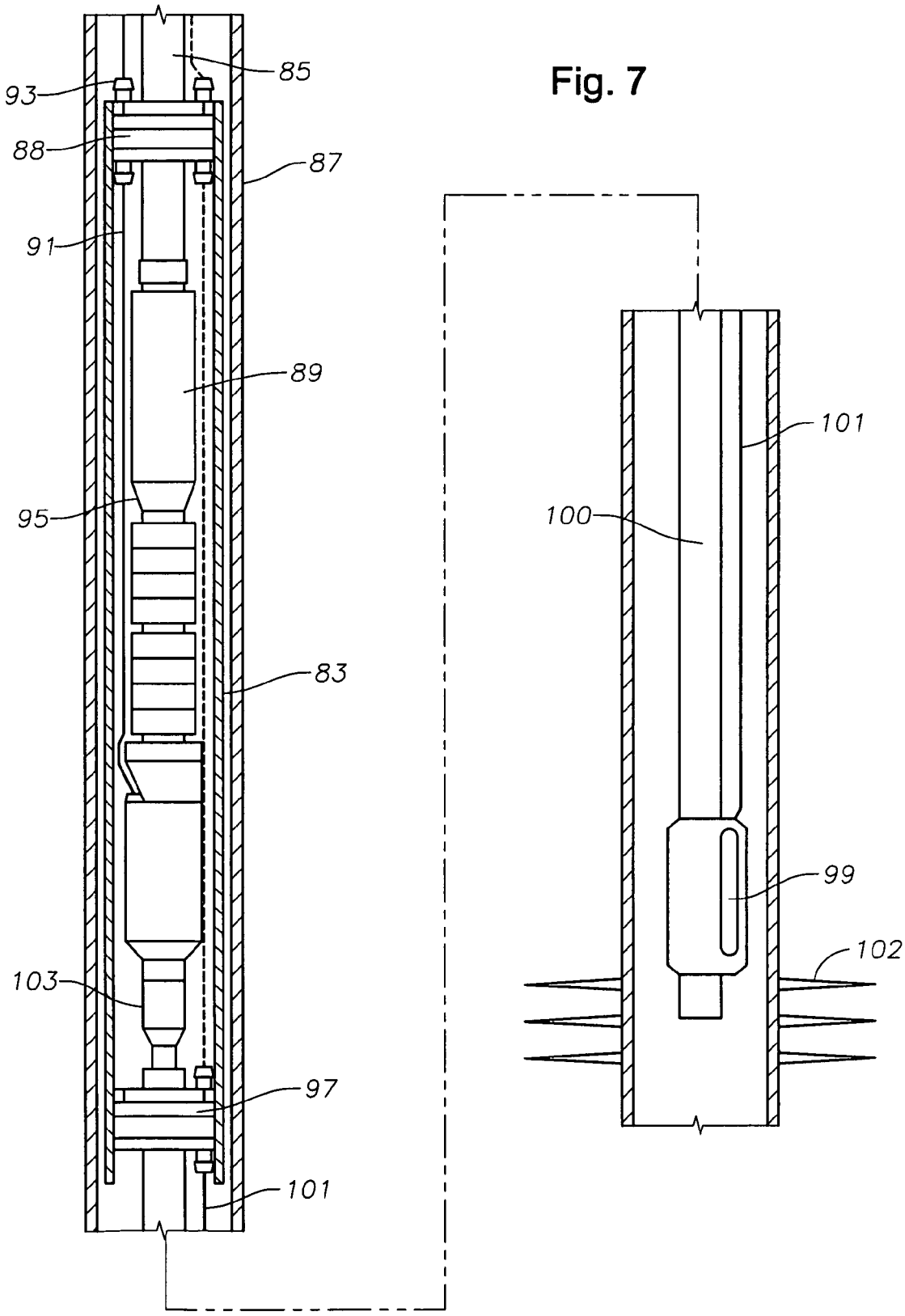
FIG. 7 is a vertical sectional view of an alternate embodiment of a capsule, wherein one of the ESP modules of the capsule is a downhole sensor assembly.

Referring to FIG. 7, an alternate embodiment is shown wherein only one ESP is utilized. In this embodiment, capsule 83 is suspended on a string of production tubing 85 within casing 87. ESP 89 is supported by an upper hanger 88, which in turn is connected to tubing 85. A motor lead 91 extends sealingly through a penetrator 93 in upper hanger 88 and down to the motor of ESP 89. ESP 89 has a pump intake 95, which is in capsule 83. A hanger or bulkhead 97 is located at the lower end of ESP 89. Hanger 97 may be constructed as in either the first embodiment of FIG. 2 or the second embodiment of FIG. 3, or it could be a packer.

In this embodiment, the lower end of capsule 83 terminates at lower hanger 97. In this example, a downhole sensor 99 is suspended on a tubular member or stinger 100 that is mounted to lower hanger 97. Sensor 99 is a conventional electrical device that senses various characteristics of the reservoir, such as pressure and water/oil contact, and will be referred to herein as a reservoir sensor. Tubular member 100 has a length selected to place reservoir sensor 99 close to perforations 102 of the reservoir. The well fluid flows upward through tubular member 100 into the interior of capsule 83 and into pump intake 95. Tubular member 100 could sting into a packer, if desired.

Optionally ESP 89 also has a conventional ESP motor sensor 103 mounted at its base. ESP sensor 103 measures parameters of the well fluid inside capsule 83, such as intake and discharge pressure, motor temperature and vibration. ESP sensor 103 is connected electrically to the motor of ESP 89, and the signal of ESP sensor 103 may be sent via ESP motor lead 91 and power cable to the surface. At the surface, circuitry separates the signal of ESP sensor 103 from the electrical power and provides a display.

If such an ESP sensor 103 is utilized, preferably a sensor lead 101 leads from reservoir sensor 99 alongside conduit 100 and sealingly through lower hanger 97 to ESP sensor 103. In that way, the signal from reservoir sensor 99 is also superimposed on motor lead 91 and the power cable for reception at the surface. Alternately, reservoir sensor lead 101 could extend through upper hanger 88 and alongside tubing 85 to the surface as indicated by the dotted lines in FIG. 7, and ESP sensor 103 could transmit its signals in a conventional manner on the power cable. If an ESP sensor 103 is not utilized, the signals for reservoir sensor 99 would preferably be communicated through reservoir sensor lead 101 to the surface.

Although not shown, a dual ESP system could be employed in which the lower ESP is not located within a capsule, but is suspended below the capsule containing the upper ESP. This system could particularly be employed when a packer is not required. In addition, the capsule could be located within a subsea flowline rather than within a well, in which case the ESP or ESP's would be oriented approximately horizontal.

The invention has significant advantages. In the dual ESP environment, the operator can use one ESP until it breaks down, then operate with the second ESP. This substitution extends the time before the tubing must be pulled. The capsule supports the weight of the lower ESP or a downhole reservoir sensor, rather than imposing a load on the upper ESP. If desired, the dedicated line normally used for a downhole reservoir sensor could be eliminated and signals superimposed on the ESP power cable.

While the invention has been shown in only a few of its forms, it should be apparent to those skilled in the art that it is not so limited but is susceptible to various changes without departing from the scope of the invention.

The invention claimed is:

1. A well pumping apparatus, comprising:

a capsule having an upper end for connection to a string of production tubing lowered within casing of a well;

an upper pump assembly including a pump and a motor located within and suspended by the upper end of the capsule;

an upper motor lead extending from the motor alongside the pump within the capsule and sealingly through the upper end of the capsule;

a bulkhead within the capsule below the upper pump assembly and above a lower end of the capsule;

lower pump assembly including a pump and a motor located within the capsule below the bulkhead; and a lower motor lead extending from the motor of the lower pump assembly through the bulkhead;

the bulkhead sealingly engaging the capsule, defining an upper chamber and a lower chamber within the capsule;

the upper pump assembly having an intake in the upper chamber and a discharge conduit connected to the upper end of the capsule;

the lower pump assembly having an intake in the lower chamber and a discharge conduit connected to the bulkhead, the discharge conduit leading through the bulkhead into the upper chamber; and a discharge port located in the discharge conduit of the lower pump assembly and in the upper chamber.

2. The apparatus according to claim 1, wherein the bulkhead is connected to and supported by the upper pump assembly.

3. The apparatus according to claim 2, wherein:

the bulkhead has an outer diameter portion that sealingly engages an inner diameter portion of the capsule, and the bulkhead is axially movable relative to the capsule in response to thermal growth of the upper pump assembly during operation.

4. The apparatus according to claim 1, wherein:

the bulkhead is mounted within the capsule to prevent downward movement relative to the capsule; and a telescoping joint connects a lower end of the pump assembly to the bulkhead to allow thermal growth of the pump assembly relative to the bulkhead.

5. The apparatus according to claim 1, further comprising:

an upper sleeve valve in the discharge conduit of the upper pump assembly in the upper chamber for selectively opening and closing communication of the discharge conduit of the upper pump assembly to the upper chamber; and a lower sleeve valve in the discharge conduit of the lower pump assembly within the lower chamber for selectively opening and closing communication of the discharge conduit of the lower pump assembly to the lower chamber.

6. The apparatus according to claim 5, wherein:

the apparatus has a first mode of operation in which both of the pump assemblies are operating and both sleeve valves are closed;

the apparatus has a second mode of operation in which only the upper pump assembly is in operation, the upper sleeve valve is closed, and the lower sleeve valve is open; and the apparatus has a third mode of operation in which only the lower pump assembly is operating, and the lower sleeve valve is closed and the upper sleeve valve is open.

7. The apparatus according to claim 5, further comprising:

at least one hydraulic line extending sealingly through an upper end of the capsule to the upper sleeve valve and sealingly through the bulkhead to the lower sleeve valve for selectively opening and closing the upper and lower sleeve valves.

8. A well fluid pumping apparatus, comprising:

a capsule having an inlet for receiving well fluid and an outlet for discharging well fluid;

upstream and downstream pump assemblies located within the capsule, each having a pump and a submersible electrical motor, a bulkhead within the capsule between the upstream and downstream pump assemblies, dividing the capsule into upstream and downstream chambers sealed from each other, an intake of the upstream pump assembly being in the upstream chamber, an intake of the downstream pump assembly being in the downstream chamber, the inlet of the capsule being in communication with the upstream chamber;

an upstream conduit extending from a discharge of the upstream pump assembly through the bulkhead into the downstream chamber;

a downstream conduit connected between a discharge of the downstream pump assembly and the outlet of the capsule; and the upstream and downstream pump assemblies having a dual operation mode wherein well fluid flows through the inlet of the capsule into the upstream chamber, is pumped to a first pressure level by the upstream pump assembly and discharged through the upstream conduit into the downstream chamber, then pumped to a second pressure level by the downstream pump assembly and discharged through the downstream conduit out the outlet of the capsule.

9. The apparatus according to claim 8, further comprising:

an upstream port within the upstream chamber in the upstream conduit;

an upstream valve that selectively opens and closes the upstream port, the upstream valve being closed while the upstream and downstream pump assemblies are in the dual mode; and the upstream and downstream pump assemblies having a downstream pump assembly only mode of operation, wherein the upstream pump assembly ceases operation, the upstream valve is opened, and well fluid flows through the inlet of the capsule into the upstream chamber, through the upstream port and out the upstream conduit into the downstream chamber, then is pumped by the downstream pump assembly out the outlet of the capsule.

10. The apparatus according to claim 9, further comprising:

at least one hydraulic line extending sealingly through an upper end of the capsule and the bulkhead to the upstream valve for selectively opening and closing the upstream valve.

11. The apparatus according to claim 8, further comprising:

a downstream port within the downstream chamber in the downstream conduit;

a downstream valve that selectively opens and closes the downstream port, the downstream valve being closed while the upstream and downstream pump assemblies are in the dual mode; and the upstream and downstream pump assemblies having an upstream pump assembly only mode of operation, wherein the downstream pump assembly ceases operation, the downstream valve is opened, and well fluid flows through the inlet of the capsule into the upstream chamber, and is pumped by the downstream pump through the upstream conduit into the downstream chamber, then through the downstream port into the downstream conduit and out the outlet of the capsule.

12. The apparatus according to claim 11, further comprising:

at least one hydraulic line extending sealingly through an upper end of the capsule to the downstream valve for selectively opening and closing the downstream valve.

13. The apparatus according to claim 8, further comprising:

an upstream port within the upstream chamber in the upstream conduit;

an upstream valve that selectively opens and closes the upstream port, the upstream valve being closed while the upstream and downstream pump assemblies are in the dual mode;

a downstream port within the downstream chamber in the downstream conduit;

a downstream valve that selectively opens and closes the downstream port, the downstream valve being closed while the upstream and downstream pump assemblies are in the dual mode;

the upstream and downstream pump assemblies having a downstream pump assembly only mode of operation, wherein the upstream pump assembly ceases operation, the upstream valve is opened and the downstream valve closed, and well fluid flows through the inlet of the capsule into the upstream chamber, through the upstream port and out the upstream conduit into the downstream chamber, then is pumped by the downstream pump assembly out the outlet of the capsule; and the upstream and downstream pump assemblies having an upstream pump assembly only mode of operation, wherein the downstream pump assembly ceases operation, the downstream valve is opened and the upstream valve is closed, and well fluid flows through the inlet of the capsule into the upstream chamber, and is pumped by the upstream pump through the upstream conduit into the downstream chamber, then through the downstream port into the downstream conduit and out the outlet of the capsule.

14. The apparatus according to claim 13, wherein:

the upstream and downstream valves are biased to an open position;

operation of the upstream pump causes the upstream valve to close; and operation of the downstream pump causes the downstream valve to close.

15. The apparatus according to claim 8, wherein:

the bulkhead has an outer diameter portion that sealingly engages an inner diameter portion of the capsule, and the bulkhead is axially movable relative to the capsule in response to thermal growth of the pump assembly during operation.

16. The apparatus according to claim 8, wherein:

the bulkhead is fixed in the capsule to prevent downward movement of the bulkhead relative to the capsule; and a telescoping joint connects an end of the downstream pump assembly to the bulkhead to allow thermal growth of the downstream pump assembly relative to the bulkhead.

17. A method of pumping a well fluid, comprising:

(a) mounting upstream and downstream pump assemblies within a capsule, each having a pump and a submersible electrical motor, the capsule having a bulkhead between the upstream and downstream pump assemblies, dividing the capsule into upstream and downstream chambers sealed from each other, an intake of the upstream pump assembly being in the upstream chamber, an intake of the downstream pump assembly being in the downstream chamber; and (b) operating the upstream and downstream pump assemblies in a dual operation mode, causing well fluid to flow through an inlet of the capsule into the upstream chamber where the well fluid is pumped by the upstream pump assembly and discharged through the bulkhead into the downstream chamber, wherein the well fluid is pumped by the downstream pump assembly and discharged out an outlet of the capsule.

18. The method according to claim 17, wherein step (b) further comprises:

operating in a downstream pump assembly only operation by ceasing operation of the upstream pump, and flowing the well fluid from the inlet of the capsule directly to the downstream chamber, thereby bypassing the upstream pump assembly.

19. The method according to claim 17, wherein step (b) further comprises:

operating in an upstream pump assembly only operation by ceasing operation of the downstream pump, and flowing the well fluid from the inlet of the capsule and from the upstream pump assembly directly to the downstream chamber and out the outlet of the capsule, thereby bypassing the downstream pump assembly.

* * * * *

UNITED STATES PATENT AND TRADEMARK OFFICE

CERTIFICATE OF CORRECTION

PATENT NO. : 7,736,133 B2
APPLICATION NO. : 11/750014
DATED : June 15, 2010
INVENTOR(S) : Ignacio Martinez It is certified that error appears in the above-identified patent and that said Letters Patent is hereby corrected as shown below:

Column 2, line 38, insert --in-- before "communication"
Column 6, line 49, insert --a-- before "lower pump"
Column 6, line 50, delete "and"

Signed and Sealed this

Sixteenth Day of November, 2010

David J. Kappos

David J. Kappos
*Director of the United States Patent and Trademark Office*